US007655138B2

(12) United States Patent
Hoover et al.

(10) Patent No.: US 7,655,138 B2
(45) Date of Patent: Feb. 2, 2010

(54) DESULFURIZATION PROCESS

(75) Inventors: Victor G Hoover, Pearl River, LA (US); Daniel T Fernald, Friendswood, TX (US); Gwen J DeBrower, Springfield, PA (US)

(73) Assignee: China Petroleum & Chemical Corporation, Beijing (CN)

( * ) Notice: Subject to any disclaimer, the term of this patent is extended or adjusted under 35 U.S.C. 154(b) by 398 days.

(21) Appl. No.: 11/562,529

(22) Filed: Nov. 22, 2006

(65) Prior Publication Data

US 2008/0116113 A1 May 22, 2008

(51) Int. Cl.
*C10G 25/00* (2006.01)
*C10G 25/12* (2006.01)

(52) U.S. Cl. ..... 208/250; 208/247; 208/173; 208/176

(58) Field of Classification Search ..... 208/208 R, 208/244, 247, 250, 299, 305, 173, 176
See application file for complete search history.

(56) References Cited

U.S. PATENT DOCUMENTS

| | | | | |
|---|---|---|---|---|
| 2,892,773 | A | 6/1959 | Hirsch et al. | |
| 4,220,622 | A | 9/1980 | Kelley | |
| 5,447,702 | A | 9/1995 | Campbell et al. | |
| 5,578,093 | A | 11/1996 | Campbell et al. | |
| 6,890,877 | B2 | 5/2005 | Meier et al. | |
| 2003/0192811 | A1 * | 10/2003 | Thompson et al. | 208/208 R |
| 2005/0199531 | A1 * | 9/2005 | Hoover et al. | 208/208 R |
| 2006/0243642 | A1 | 11/2006 | Thompson et al. | |

* cited by examiner

*Primary Examiner*—Walter D Griffin
*Assistant Examiner*—Renee Robinson
(74) *Attorney, Agent, or Firm*—Hovey Williams LLP

(57) ABSTRACT

A system which circulates fluidizable solid particles through a fluidized bed reactor, a fluidized bed regenerator, and a fluidized bed reducer to thereby provide for substantially continuous desulfurization of a hydrocarbon-containing fluid stream and substantially continuous regeneration of the solid particles is disclosed.

25 Claims, 1 Drawing Sheet

DESULFURIZATION PROCESS

DETAILED DESCRIPTION OF THE PREFERRED EMBODIMENTS

Figure 1:
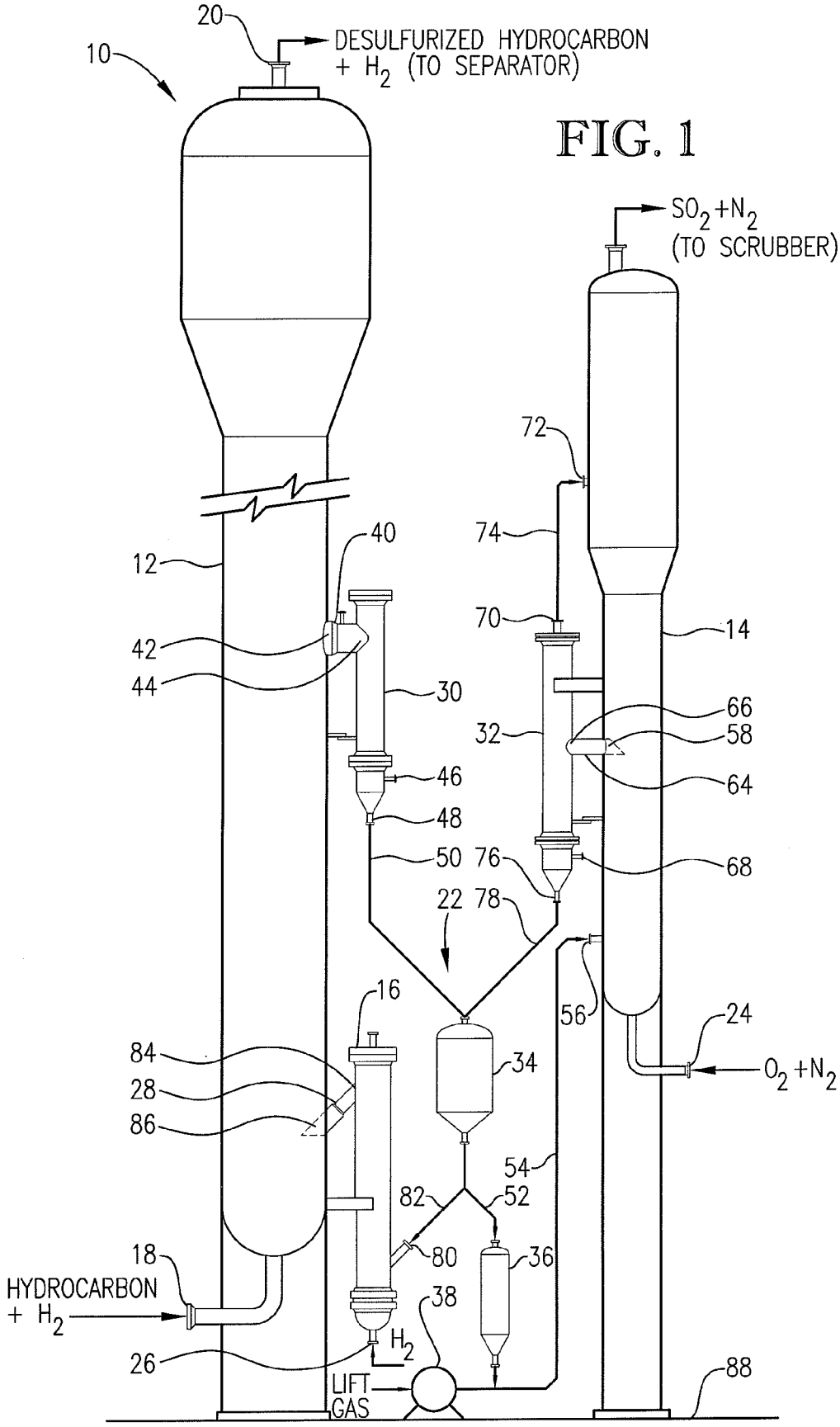
FIG. 1 is a schematic diagram of a desulfurization unit constructed in accordance with the principals of the present invention, particularly illustrating the relative elevations of various vessels employed in the desulfurization unit and the manner in which these vessels are connected so as to allow for circulation of solid particles through the unit.

This invention includes a method of desulfurizing a hydrocarbon-containing fluid, said method comprising the steps of:

(a) contacting said hydrocarbon-containing fluid with solid particles in a desulfurization zone under desulfurization conditions sufficient to remove sulfur from said hydrocarbon-containing fluid, thereby providing sulfur loaded solid particles;

(b) batchwise transporting said sulfur loaded solid particles from said desulfurization zone to a lock hopper;

(c) depressurizing said lock hopper to a drain pressure, thereby providing a depressurized filled lock hopper;

(d) batchwise transporting said sulfur loaded solid particles from said depressurized filled lock hopper to a regenerator feed drum;

(e) substantially continuously transporting said sulfur loaded solid particles from said regenerator feed drum to a regeneration zone;

(f) contacting said sulfur loaded solid particles with an oxygen-containing regeneration stream in said regeneration zone under regeneration conditions sufficient to remove sulfur from said sulfur loaded solid particles, thereby providing regenerated solid particles;

(g) batchwise transporting said regenerated solid particles from said regeneration zone to said lock hopper;

(h) pressurizing said lock hopper to a fill pressure, thereby providing a pressurized lock hopper;

(i) batchwise transporting said regenerated solid particles from said pressurized lock hopper to a reducing zone; and (j) contacting said regenerated solid particles with a hydrogen-containing reducing stream in said reducing zone under reducing conditions sufficient to reduce said solid particles, thereby providing reduced stripped solid particles.

Referring initially to FIG. 1, a desulfurization unit 10 is illustrated as generally comprising a fluidized bed reactor 12 (also referred to as a reaction zone), a fluidized bed regenerator 14 (also referred to as a regeneration zone), and a fluidized bed reducer 16 (also referred to as a reducing zone). Solid particles are circulated in desulfurization unit 10 to provide for continuous sulfur removal from a sulfur-containing hydrocarbon, such as cracked-gasoline or diesel fuel, entering desulfurization unit 10 via a feed inlet 18. The solid particles employed in desulfurization unit 10 can be any sufficiently fluidizable, circulatable, and regenerable zinc oxide-based composition having sufficient desulfurization activity and sufficient attrition resistance. A description of such a composition is provided in U.S. Pat. No. 6,429,170 and U.S. Pat. No. 6,864,215, the entirety of all disclosures of which are incorporated herein by reference.

A hydrocarbon-containing fluid stream enters reactor 12 via feed inlet 18 and is passed upwardly through a bed of solid particles, which have been previously reduced, in the desulfurization zone of reactor 12. The solid particles contacted with the hydrocarbon-containing stream in reactor 12 preferably initially (i.e., immediately prior to contacting with the hydrocarbon-containing fluid stream) comprise zinc oxide and a reduced-valence promoter metal component.

The reduced-valence promoter metal component of the solid particles preferably comprises a promoter metal selected from a group consisting of nickel, cobalt, iron, manganese, tungsten, silver, gold, copper, platinum, zinc, tin, ruthenium, molybdenum, antimony, vanadium, iridium, chromium, palladium, and mixtures of two or more thereof. More preferably, the reduced-valence promoter metal component comprises nickel as the promoter metal. As used herein, the term "reduced-valence" when describing the promoter metal component, shall denote a promoter metal component having a valence which is less than the valence of the promoter metal component in its common oxidized state. More specifically, the solid particles employed in reactor 12 should include a promoter metal component having a valence which is less than the valence of the promoter metal component of the regenerated (i.e., oxidized) solid particles exiting regenerator 14. Most preferably, substantially all of the promoter metal component of the solid particles has a valence of zero (0).

In a preferred embodiment of the present invention the reduced-valence promoter metal component comprises, consists of, or consists essentially of, a substitutional solid metal solution characterized by the formula: $M_A Zn_B$, wherein M is the promoter metal, Zn in zinc, and A and B are each numerical values in a range of from 0.01 to 0.99. In the above formula for the substitutional solid metal solution, it is preferred for A to be in a range of from about 0.70 to about 0.97, and most preferably in a range of from about 0.85 to about 0.95. It is further preferred for B to be in a range of from about 0.03 to about 0.30, and most preferably in a range of from about 0.05 to 0.15, for best sulfur removal. Preferably, B is equal to (1−A).

In addition to zinc oxide and the reduced-valence promoter metal component, the reduced solid particles employed in reactor 12 may further comprise a porosity enhancer and a promoter metal-zinc aluminate substitutional solid solution. The promoter metal-zinc aluminate substitutional solid solution can be characterized by the formula: $M_Z Zn_{(1-Z)} Al_2 O_4$), wherein M is the promoter metal and the subscript Z is a numerical value in the range of from 0.01 to 0.99. The porosity enhancer, when employed, can be any compound which ultimately increases the macroporosity of the solid particles. Preferably, the porosity enhancer is perlite. The term "perlite" as used herein is the petrographic term for a siliceous volcanic rock which naturally occurs in certain regions throughout the world. The distinguishing feature, which sets it apart from other volcanic minerals, is its ability to expand four to twenty times its original volume when heated to certain temperatures. When heated above 1600° F., crushed perlite expands due to the presence of combined water with crude perlite rock. The combined water vaporizes during the heating process and creates countless tiny bubbles in the heat softened glassy particles. These diminutive glass sealed bubbles account for its light weight. Expanded perlite can be manufactured to weigh as little as 2.5 lbs per cubic foot. Typical chemical analysis properties, based on mass, of expanded perlite are approximately: silicon dioxide 73%, aluminum oxide 17%, potassium oxide 5%, sodium oxide 3%, calcium oxide 1%, plus trace elements. Typical physical properties of expanded perlite are approximately: softening point 1600-2000° F., fusion point 2300° F.-2450° F., pH 6.6-6.8, and specific gravity 2.2-2.4. The term "expanded perlite" as used herein refers to the spherical form of perlite which has been expanded by heating the perlite siliceous volcanic rock to a temperature above 1600° F. The term "particulate expanded perlite" or "milled perlite" as used herein denotes that form of expanded perlite which has been subjected to crushing so as to form a particulate mass wherein the particle size of such mass is comprised of at least 97% of particles having a size of less than 2 microns. The term "milled expanded perlite" is intended to mean the product resulting from subjecting expanded perlite particles to milling or crushing.

The reduced solid particles that are initially contacted with the hydrocarbon-containing fluid stream in reactor 12 preferably comprise zinc oxide, a reduced-valence promoter metal component ($M_AZn_B$), a porosity enhancer (PE), and a promoter metal-zinc aluminate ($M_ZZn_{(1-Z)}Al_2O_4$) in the ranges provided below in Table 1.

TABLE 1

| Components of the Reduced Solid Particles | | | | |
|---|---|---|---|---|
| Range | ZnO (wt %) | $M_AZn_B$ (wt %) | PE (wt %) | $M_ZZn_{(1-Z)}Al_2O_4$ (wt %) |
| Preferred | 5-80 | 5-80 | 2-50 | 1-50 |
| More Preferred | 20-60 | 20-60 | 5-30 | 5-30 |
| Most Preferred | 30-50 | 30-40 | 10-20 | 10-20 |

The physical properties of the solid particles which significantly affect the suitability of the particles for use in desulfurization unit 10 include, for example, particle shape, particle size, particle density, and particle resistance to attrition. Solid particles employed in desulfurization unit 10 preferably comprise microspherical particles having a mean particle size in the range of from about 20 to about 150 microns, more preferably in the range of from about 50 to about 100 microns, and most preferably in the range of from 60 to 80 microns for best desulfurization activity and desulfurization reactor operations. The density of the solid particles is preferably in a range of from about 0.5 to about 1.5 grams per cubic centimeter (g/cc), more preferably in a range of from about 0.8 to about 0.3 g/cc, and most preferably in a range of from 0.9 to 1.2 g/cc for best desulfurization operations. The particle size and density of the solid particles preferably qualify the solid particles as a Group A solid under the Geldart group classification system described in Powder Technol., 7, 285-292 (1973).

The solid particles preferably have high resistance to attrition. As used herein, the term "attrition resistance" denotes a measure of a particle's resistance to size reduction under controlled conditions of turbulent motion. The attrition resistance of a particle can be quantified using the jet cup attrition test, similar to the Davidson Index. The Jet Cup Attrition Index (JCAI) represents the weight percent of the over 44 micrometer particle size fraction which is reduced to particle sizes of less than 37 micrometers under test conditions and involves screening a 5 gram sample of to remove particles in the 0 to 44 micrometer size range. The particles above 44 micrometers are then subjected to a tangential jet of air at a rate of 21 liters per minute introduced through a 0.0625 inch orifice fixed at the bottom of a specially designed jet cup (1" I.D.×2" height) for a period of 1 hour. The Jet Cup Attrition Index (JCAI) is calculated as follows:

$$JCAI = \frac{Wt.\ \text{of}\ 0-37\ \text{Micron Formed During Test}}{Wt.\ \text{of Original} + 44\ \text{Micron Fraction Being Tested}} \times 100 \times \text{Correction Factor}$$

The correction factor (presently 0.3) is determined using a known calibration standard to adjust for the differences in jet cup dimensions and wear. The solid particles employed in the present invention preferably have a Jet Cup Attrition Index (JCAI) value of less than about 30, more preferably less than about 20, and most preferably less than 10 for best desulfurization operations.

The hydrocarbon-containing fluid stream contacted with the reduced solid particles in reactor 12 preferably comprises a sulfur-containing hydrocarbon and hydrogen. The molar ratio of the hydrogen to the sulfur-containing hydrocarbon charged to reactor 12 via inlet 18 is preferably in a range of from about 0.1:1 to about 3:1, more preferably in a range of from about 0.2:1 to about 1:1, and most preferably in a range of from 0.4:1 to 0.8:1 for best desulfurization operations. Preferably, the sulfur-containing hydrocarbon is a fluid which is normally in a liquid state at standard temperature and pressure, but which exists in a gaseous state when combined with hydrogen, as described above, and exposed to the desulfurization conditions in reactor 12. The sulfur-containing hydrocarbon preferably can be used as a fuel or a precursor to fuel. Examples of suitable sulfur-containing hydrocarbons include, but are not limited to, cracked-gasoline, diesel fuels, jet fuels, straight-run naphtha, straight-run distillates, coker gas oil, coker naphtha, alkylates, and straight-run gas oil. Most preferably, the sulfur-containing hydrocarbon comprises a hydrocarbon fluid selected from the group consisting of gasoline, cracked-gasoline, diesel fuel, and mixtures thereof.

As used herein, the term "gasoline" denotes a mixture of hydrocarbons boiling in a range of from about 100° F. to about 400° F., or any fraction thereof. Examples of suitable gasolines include, but are not limited to, hydrocarbon streams in refineries such as naphtha, straight-run naphtha, coker naphtha, catalytic gasoline, visbreaker naphtha, alkylates, isomerate, reformate, and the like, and mixtures thereof.

As used herein, the term "cracked-gasoline" denotes a mixture of hydrocarbons boiling in a range of from about 100° F. to about 400° F., or any fraction thereof, that are products of either thermal or catalytic processes that crack larger hydrocarbon molecules into smaller molecules. Examples of suitable thermal processes include, but are not limited to, coking, thermal cracking, visbreaking, and the like, and combinations thereof. Examples of suitable catalytic cracking processes include, but are not limited to, fluid catalytic cracking, heavy oil cracking, and the like, and combinations thereof. Thus, examples of suitable cracked-gasolines include, but are not limited to, coker gasoline, thermally cracked gasoline, visbreaker gasoline, fluid catalytically cracked gasoline, heavy oil cracked-gasoline and the like, and combinations thereof. In some instances, the cracked-gasoline may be fractionated and/or hydrotreated prior to desulfurization when used as the sulfur-containing fluid in the process in the present invention.

As used herein, the term "diesel fuel" denotes a mixture of hydrocarbons boiling in a range of from about 300° F. to about 750° F., or any fraction thereof. Examples of suitable diesel fuels include, but are not limited to, light cycle oil, kerosene, jet fuel, straight-run diesel, hydrotreated diesel, and the like, and combinations thereof.

The sulfur-containing hydrocarbon described herein as suitable feed in the inventive desulfurization process comprises a quantity of olefins, aromatics, and sulfur, as well as paraffins and naphthenes. The amount of olefins in gaseous cracked-gasoline is generally in a range of from about 10 to about 35 weight percent olefins based on the total weight of the gaseous cracked-gasoline. For diesel fuel there is essentially no olefin content. The amount of aromatics in gaseous cracked-gasoline is generally in a range of from about 20 to about 40 weight percent aromatics based on the total weight of the gaseous cracked-gasoline. The amount of aromatics in gaseous diesel fuel is generally in a range of from about 10 to about 90 weight percent aromatics based on the total weight of the gaseous diesel fuel. The amount of atomic sulfur in the sulfur-containing hydrocarbon fluid, preferably cracked-gasoline or diesel fuel, suitable for use in the inventive desulfurization process is generally greater than about 50 parts per million by weight (ppmw) of the sulfur-containing hydrocarbon fluid, more preferably in a range of from about 100 ppmw atomic sulfur to about 10,000 ppmw atomic sulfur, and most preferably from 150 ppmw atomic sulfur to 5,000 ppmw atomic sulfur. It is preferred for at least about 50 weight percent of the atomic sulfur present in the sulfur-containing hydrocarbon fluid employed in the present invention to be in the form of organosulfur compounds. More preferably, at least about 75 weight percent of the atomic sulfur present in the sulfur-containing hydrocarbon fluid is in the form of organosulfur compounds, and most preferably at least 90 weight percent of the atomic sulfur is in the form of organosulfur compounds. As used herein, "sulfur" used in conjunction with "ppmw sulfur" or the term "atomic sulfur", denotes the amount of atomic sulfur (about 32 atomic mass units) in the sulfur-containing hydrocarbon, not the atomic mass, or weight, of a sulfur compound, such as an organosulfur compound.

As used herein, the term "sulfur" denotes sulfur in any form normally present in a sulfur-containing hydrocarbon such as cracked-gasoline or diesel fuel. Examples of such sulfur which can be removed from a sulfur-containing hydrocarbon fluid through the practice of the present invention include, but are not limited to, hydrogen sulfide, carbonyl sulfide (COS), carbon disulfide ($CS_2$), mercaptans (RSH), organic sulfides (R—S—R), organic disulfides (R—S—S—R), thiophene, substituted thiophenes, organic trisulfides, organic tetrasulfides, benzothiophene, alkyl thiophenes, alkyl benzothiophenes, alkyl dibenzothiophenes, and the like, and combinations thereof, as well as heavier molecular weights of the same which are normally present in sulfur-containing hydrocarbons of the types contemplated for use in the desulfurization process of the present invention, wherein each R can by an alkyl, cycloalkyl, or aryl group containing 1 to 10 carbon atoms.

As used herein, the term "fluid" denotes gas, liquid, vapor, and combinations thereof.

As used herein, the term "gaseous" denotes the state in which the sulfur-containing hydrocarbon fluid, such as cracked-gasoline or diesel fuel, is primarily in a gas or vapor phase.

As used herein, the term "finely divided" denotes particles having a mean particle size less than 500 microns.

Referring again to FIG. 1, in fluidized bed reactor 12 the finely divided reduced solid particles are contacted with the upwardly flowing gaseous hydrocarbon-containing fluid stream under a set of desulfurization conditions sufficient to produce a desulfurized hydrocarbon and sulfur-loaded solid particles. The flow of the hydrocarbon-containing fluid stream is sufficient to fluidize the bed of solid particles located in the desulfurization zone of reactor 12. The desulfurization conditions in reactor 12 include temperature, pressure, weight hourly space velocity (WHSV), and superficial velocity. The preferred ranges for such desulfurization conditions are provided below in Table 2.

TABLE 2

Desulfurization Conditions

| Range | Temp (° F.) | Press. (psig) | WHSV ($hr^{-1}$) | Superficial Vel. (ft/s) |
|---|---|---|---|---|
| Preferred | 250-1200 | 50-750 | 0.1-10 | 0.25-10 |
| More Preferred | 500-1000 | 100-600 | 0.2-8 | 0.5-4 |
| Most Preferred | 700-850 | 150-500 | 0.5-5 | 1.0-1.5 |

When the solid particles are contacted with the hydrocarbon-containing fluid stream in reactor 12 under desulfurization conditions, sulfur compounds, particularly organosulfur compounds, present in the hydrocarbon-containing fluid stream are removed from such fluid stream. At least a portion of the sulfur removed from the hydrocarbon-containing fluid stream is employed to convert at least a portion of the zinc oxide of the solid particles into zinc sulfide.

In contrast to many conventional sulfur removal processes, such as, for example, hydrodesulfurization, it is preferred that substantially none of the sulfur in the sulfur-containing hydrocarbon fluid is converted to, and remains as, hydrogen sulfide during desulfurization in reactor 12. Rather, it is preferred that the fluid effluent from a product outlet 20 of reactor 12 (generally comprising the desulfurized hydrocarbon-containing fluid and hydrogen) comprises less than the amount of hydrogen sulfide, if any, in the fluid feed charged to reactor 12 (generally comprising the sulfur-containing hydrocarbon-containing fluid and hydrogen). The fluid effluent from reactor 12 preferably contains less than about 50 weight percent of the amount of sulfur in the fluid feed charged to reactor 12, more preferably less than about 20 weight percent of the amount of sulfur in the fluid feed, and most preferably less than 5 weight percent of the amount of sulfur in the fluid feed. It is preferred for the total sulfur content of the fluid effluent from reactor 12 to be less than about 50 parts per million by weight (ppmw) of the total fluid effluent, more preferably less than about 30 ppmw, still more preferably less than about 15 ppmw, and most preferably less than 10 ppmw.

Referring again to FIG. 1, during desulfurization in reactor 12, at least a portion of the sulfur loaded solid particles are withdrawn from reactor 12 and transported to regenerator 14 via a transport assembly 22. In regenerator 14, the sulfur loaded solid particles are contacted with an oxidizing, preferably an oxygen-containing, regeneration stream which enters regenerator 14 via a regeneration stream inlet 24. The oxygen-containing regeneration stream preferably comprises at least 1 mole percent oxygen with the remainder being a gaseous diluent. More preferably, the oxygen-containing regeneration stream comprises in the range of from about 1 to about 50 mole percent oxygen and in the range of from about 50 to about 95 mole percent nitrogen, still more preferable in the range of from about 2 to about 20 mole percent oxygen and in the range of from about 70 to about 90 mole percent nitrogen, and most preferably in the range of from 3 to 10 mole percent oxygen and in the range of from 75 to 85 mole percent nitrogen.

The regeneration conditions in regenerator 14 are sufficient to convert at least a portion of the zinc sulfide of the sulfur loaded solid particles into zinc oxide via contacting with the oxygen-containing regeneration stream. The preferred ranges for such regeneration conditions are provided below in Table 3.

TABLE 3

| Range | Regeneration Conditions Temp (° F.) | Press. (psig) | Superficial Vel. (ft/s) |
|---|---|---|---|
| Preferred | 500-1500 | 10-250 | 0.5-10 |
| More Preferred | 700-1200 | 20-150 | 0.75-5 |
| Most Preferred | 900-1100 | 30-75 | 1.5-3.0 |

When the sulfur loaded solid particles are contacted with the oxygen-containing regeneration stream under the regeneration conditions described above, at least a portion of the promoter metal component is oxidized to form an oxidized promoter metal component. Preferably, in regenerator 14 the substitutional solid solution ($M_AZn_B$) and/or sulfided substitutional solid solution ($M_AZn_BS$) of the sulfur-loaded is converted to a substitutional solid metal oxide solution characterized by the formula: $M_XZn_YO$, wherein M is the promoter metal, Zn is zinc, and X and Y are each numerical values in a range of from 0.01 to about 0.99. In the above formula, it is preferred for X to be in a range of from about 0.5 to about 0.9 and most preferably from 0.6 to 0.8. It is further preferred for Y to be in a range of from about 0.1 to about 0.5, and most preferably from 0.2 to 0.4. Preferably, Y is equal to (1−X).

The regenerated solid particles exiting regenerator 14 preferably comprise zinc oxide, the oxidized promoter metal component ($M_XZn_YO$), the porosity enhancer (PE), and the promoter metal-zinc aluminate ($M_ZZn_{(1-Z)}Al_2O_4$) in the ranges provided below in Table 4.

TABLE 4

| Range | Components of the Regenerated Solid Particles ZnO (wt %) | $M_XZn_YO$ (wt %) | PE (wt %) | $M_ZZn_{(1-Z)}Al_2O_4$ (wt %) |
|---|---|---|---|---|
| Preferred | 5-80 | 5-70 | 2-50 | 1-50 |
| More Preferred | 20-60 | 15-60 | 5-30 | 5-30 |
| Most Preferred | 30-50 | 20-40 | 10-20 | 10-20 |

During regeneration in regenerator 14, at least a portion of the regenerated (i.e., oxidized) solid particles are withdrawn from the regenerator 14 and transported to reducer 16 via a second transport assembly 26. In reducer 16, the regenerated solid particles are contacted with a reducing, preferably a hydrogen-containing reducing, stream entering reducer 16 via a reducing stream inlet 26 in order to produce reduced solid particles. The hydrogen-containing reducing stream preferably comprises at least 50 mole percent hydrogen with the remainder being cracked hydrocarbon products such as, for example, methane, ethane, and propane. More preferably, the hydrogen-containing reducing stream comprises at least about 70 mole percent hydrogen, and most preferably at least 80 mole percent hydrogen. The reducing conditions in reducer 16 are sufficient to reduce the valence of the oxidized promoter metal component of the regenerated solid particles, thereby producing reduced solid particles. The preferred ranges for such reducing conditions are provided below in Table 5.

TABLE 5

| Range | Reducing Conditions Temp (° F.) | Press. (psig) | Superficial Vel. (ft/s) |
|---|---|---|---|
| Preferred | 250-1250 | 50-750 | 0.1-10 |
| More Preferred | 600-1000 | 100-600 | 0.2-3 |
| Most Preferred | 750-850 | 150-500 | 0.3-1.0 |

When the regenerated solid particles are contacted with the hydrogen-containing reducing stream in reducer 16 under the reducing conditions described above, at least a portion of the oxidized promoter metal component is reduced to form the reduced-valence promoter metal component. Preferably, at least a substantial portion of the substitutional solid metal oxide solution ($M_XZn_YO$) is converted to the reduced-valence promoter metal component ($M_AZn_B$).

After the solid particles have been reduced in reducer 16, they can be transported back to reactor 12, via close-coupling assembly 28, for recontacting with the hydrocarbon-containing fluid stream in reactor 12.

Referring again to FIG. 1, as mentioned above, solid particles are transported from reactor 12 to regenerator 14 via transport assembly 22. Transport assembly 22 generally comprises a reactor receiver 30, a regenerator receiver 32, a lock hopper 34, a regenerator feed drum 36, and a pneumatic lift 38. Reactor receiver 30 is close-coupled to reactor 12 via a reactor outlet close-coupling assembly 40, which extends from a solids outlet 42 of reactor 12 to solids inlet 44 of reactor receiver 30. As used herein, the term "close-coupled" shall denote a manner of fluidly coupling two vessels to one another wherein an open passageway is created from a solids outlet of one vessel to a solids inlet of another vessel, thereby providing for lateral dense phase transport of solids from the solids outlet to the solids inlet. As used herein, the term "dense phase transport" shall denote the transport of solids in the presence of a fluid wherein the average velocity of the fluid in the direction of transport of the solids is less than the saltation velocity. As known in the art of pneumatic particle transfer, "saltation velocity" is the minimum velocity of a fluid required to maintain full suspension of solids being transported by that fluid.

In reactor receiver 30, the downwardly gravitating solid particles are contacted with an upwardly flowing stripping gas that enters reactor receiver 30 via a stripping gas inlet 46. The contacting of the solid particles with the stripping gas in reactor receiver 30 strips excess hydrocarbon from around the solid particles. During normal operation of desulfurization unit 10, it is preferred for the solid particles to be substantially continuously transported from reactor 12 to reactor receiver 30 via close-coupling assembly 40. As used herein, the term "substantially continuously transport" shall denote a manner of continuously transporting solids, or suspended solids, during an uninterrupted transport period of at least about 10 hours.

After stripping of the solid particles in reactor receiver 30, the particles are batchwise transported from a stripper solids outlet 48 of reactor receiver 30 to an inlet of lock hopper 34 via conduit 50. As used herein, the term "batchwise transport" shall denote a manner of intermittently transporting discrete batches of solids, or suspended solids, at intervals interrupted by a period were no transporting occurs, wherein the time between transporting of sequential batches is less than about 10 hours. Thus, reactor receiver 30 continuously receives a flow of the particles discharged via solids inlet 44 and batchwise discharges the particles via solids outlet 48. The batches of solid particles discharged from solids outlet 48 are transported via gravity flow through conduit 50. As used herein, the term "gravity flow" denotes the movement of solids through a conduit, wherein the movement is caused primarily by gravitational force.

Lock hopper 34 is operable to transition the particles from the high pressure hydrocarbon environment of reactor 12 and reactor receiver 30 to the low pressure oxidizing (oxygen) environment of regenerator 14. To accomplish this transition, lock hopper 34 periodically receives batches of particles from reactor receiver 30, isolates the particles from reactor receiver 30, and is depressurized to a drain pressure, thereby changing the pressure and composition of the environment surrounding the particles from a high pressure hydrocarbon environment to a low pressure inert (e.g., nitrogen and/or argon) environment. The drain pressure is within 20 percent of the pressure in regenerator 14. After the environment of the particles has been transitioned, as described above, the particles are batchwise transported from an outlet of lock hopper 34 to an inlet of regenerator feed drum 36 via gravity flow in conduit 52.

Because the sulfur loaded solid particles are continuously withdrawn from reactor 12 but processed in a batch mode in lock hopper 34, reactor receiver 30 functions as a surge vessel wherein the sulfur loaded solid particles continuously withdrawn from reactor 12 can be accumulated between transfers of the sulfur loaded solid particles from reactor receiver 30 to lock hopper 34. Thus, reactor receiver 30 and lock hopper 34 cooperate to transition the flow of the sulfur loaded solid particles between reactor 12 and regenerator 14 from a continuous mode to a batch mode. The transfer of the sulfur loaded solid particles from reactor receiver 30 to lock hopper 34, as well as from lock hopper 34 to regenerator 14, is accomplished primarily by gravity flow, with the aid of a slight (e.g., 1-4 psi) pressure differential between the vessels. The pressures in reactor 12 and reactor receiver 30 are preferably substantially the same. The pressure in reactor 12 is preferably greater than the pressure in regenerator 14. The differential pressure between reactor 12 and regenerator 14 is preferably at least about 50 psi, more preferably at least about 75 psi, and most preferably at least 100 psi.

Regenerator feed drum 36 is operable to receive batches of particles from lock hopper 34 and substantially continuously discharge the particles to a lift line 54 of pneumatic lift 38. Thus, regenerator feed drum 36 is operable to transition the flow of particles from a batchwise flow to a substantially continuous flow. The substantially continuous flow of particles from the regenerator feed drum 36 to pneumatic lift 38 is provided via gravity flow. Pneumatic lift 38 employs a lift gas to dilute phase transport the particles upwardly to a solids inlet 56 of regenerator 14. As used herein, the term "dilute phase transport" shall denote the transport of solids by a fluid having a velocity that is at or above the saltation velocity. It is preferred for the composition of the lift gas employed in pneumatic lift 38 to be substantially the same as the composition of the regeneration stream that enters regenerator 14 via inlet 24.

In regenerator 14 the solid particles are fluidized by the regeneration stream to form a fluidized bed of the particles in the regeneration zone of the regenerator 14. As used herein, the term "fluidized bed" shall denote a system of dense phase solid particles having a fluid flowing upwardly there through at a velocity below the saltation velocity. As used herein, the term "fluidized bed vessel" shall denote a vessel for contacting a fluid with a fluidized bed of solid particles. The particles entering regenerator 14 via solids inlet 56 are, therefore, dense phase transported by the regeneration stream upwardly in regenerator 14 to a regenerator solids outlet 58.

As mentioned above, regenerated (i.e., oxidized) solid particles are transported from regenerator 14 to reducer 16 via transport assembly 22. Regenerator receiver 32 is close-coupled to regenerator 14 via a regenerator outlet close-coupling assembly 64 which extends between a regenerator solids outlet 58 and a receiver solids inlet 66. Close-coupling assembly 64 provides for substantially continuous flow of particles from regenerator 14 to regenerator receiver 32.

In regenerator receiver 32, the downwardly gravitating particles are contacted with an upwardly flowing cooling gas, which enters regenerator receiver 32 via a cooling gas inlet 68. The contacting of the cooling gas with the particles in regenerator receiver 32 cools the particles and strips residual sulfur dioxide and carbon dioxide from around the particles. It is preferred for the cooling gas to be a nitrogen-containing gas. Most preferably, the cooling gas comprises at least 90 mole percent nitrogen. Regenerator receiver 32 includes a fluid outlet 70, through which the cooling gas exits regenerator receiver 32 and flows to a cooling gas inlet 72 of regenerator 14 via conduit 74.

The particles are batchwise transported from a solids outlet 76 of regenerator receiver 32 to an inlet of lock hopper 34 via gravity flow in conduit 78. Lock hopper 34 is also operable to transition the regenerated solid particles from the low pressure oxygen environment of regenerator 14 and regenerator receiver 32 to the high pressure hydrogen environment of reducer 16. To accomplish this transition, lock hopper 34 periodically receives batches of regenerated solid particles from regenerator receiver 32, isolates regenerated particles from regenerator receiver 32, and is pressurized to a fill pressure, thereby changing the pressure and composition of the environment surrounding the particles from a low pressure oxygen environment to a high pressure hydrogen environment. The fill pressure is within 20 percent of the pressure in reactor 12. After the environment of the regenerated solid particles has been transitioned, as described above, the regenerated particles are batchwise transported from lock hopper 34 to a solids inlet 80 of reducer 16 via gravity flow in conduit 82. Because the regenerated particulates are continuously withdrawn from regenerator 14 but processed in a batch mode in lock hopper 34, regenerator receiver 32 functions as a surge vessel wherein the particulates continuously withdrawn from regenerator 14 can be accumulated between transfers of the regenerated particulates from regenerator receiver 32 to lock hopper 34. Thus, regenerator receiver 32 and lock hopper 34 cooperate to transition the flow of the regenerated solid particles between regenerator 14 and reducer 16 from a continuous mode to a batch mode. The transfer of the regenerated solid particles from regenerator receiver 32 to lock hopper 34, as well as from lock hopper 34 to reducer 16, is accomplished primarily by gravity flow with the aid of a slight (e.g., 1-4 psi) pressure differential between the vessels. The pressures in regenerator 14 and regenerator receiver 32 are preferably substantially the same. The pressure in regenerator 14 is preferably less than the pressure in reducer 16. The differential pressure between regenerator 14 and reducer 16 is preferably at least about 50 psi, more preferably at least about 75 psi, and most preferably at least 100 psi. The difference between the drain and fill pressures is preferably at least 50 psi, with the fill pressure being higher than the drain pressure.

In reducer 16, the batches of regenerated solid particles from solids inlet 80 are contacted with and fluidized by the reducing stream entering reducer 16 via a reducing stream inlet 26. The solid particles in reducer 16 are dense phase transported in the form of a fluidized bed from reducer solids inlet 80 upwardly to a reducer solids outlet 84. Reactor 12 is close-coupled to reducer 16 via close-coupling assembly 28 which extends between reducer solids outlet 84 and a reactor solids inlet 86. Close-coupling assembly 28 provides for dense phase transporting of the solid particles in a substantially batchwise fashion. As batches of solid particles enter reducer solids inlet 80, corresponding (in time) batches of reduced solid particles "spillover" into reactor 12 via close-coupling assembly 28. In reactor 12 the reduced solid particles are contacted with the hydrocarbon-containing fluid feed entering reactor 12 via inlet 18 to thereby form a fluidized bed of solid particles in reactor 12. The solid particles in reactor 12 are dense phase transported by the hydrocarbon-containing feed upwardly to reactor solids outlet 42.

Referring again to FIG. 1, the layout of desulfurization unit 10 provides a number of advantages over conventional desulfurization units which continuously circulate fluidizable solid particles between a reactor, regenerator, and reducer. The relative elevations of the individual vessels employed in desulfurization unit 10 provide for dense phase gravity flow between a number of the vessels. For example, dense phase gravity flow is provided between reactor receiver 30 and lock hopper 34 via conduit 50, lock hopper 34 and regenerator feed drum 36 via conduit 52, regenerator receiver 32 and lock hopper 34 via conduit 78, and lock hopper 34 and reducer 16 via conduit 82. Such dense phase gravity flow transport of the solid particles reduces attrition of the particles and also reduces the need for other more expensive equipment (e.g., pneumatic conveyors) to transport particles. A further advantage of the layout of desulfurization unit 10 is that the only location where dilute phase transport of the solid particles is required is in lift line 54. Other than the dilute phase transport in lift line 54, all other transport within and between the vessels of desulfurization unit 10 is accomplished in dense phase, thereby reducing attrition of the solid particles. Still another advantage of the layout of desulfurization unit 10 is the fact that the vertical elevation of the vessels above a horizontal base line 88 is minimized. Inventive desulfurization unit 10 provides an optimal layout of vessels which minimizes high velocity transport (i.e., dilute phase transport) of the solid particles, minimizes equipment, maximizes the use of gravity flow transport of the solid particles, and minimizes the elevation of the vessels above horizontal base line 88.

Reasonable variations, modifications, and adaptations may be made within the scope of this disclosure and the appended claims without departing from the scope of this invention.

That which is claimed:

1. A method of desulfurizing a hydrocarbon-containing fluid, said method comprising the steps of:

(a) contacting said hydrocarbon-containing fluid with solid particles in a desulfurization zone under desulfurization conditions sufficient to remove sulfur from said hydrocarbon-containing fluid, thereby providing sulfur loaded solid particles;

(b) batchwise transporting said sulfur loaded solid particles from said desulfurization zone to a lock hopper;

(c) depressurizing said lock hopper to a drain pressure, thereby providing a depressurized filled lock hopper;

(d) batchwise transporting said sulfur loaded solid particles from said depressurized filled lock hopper to a regenerator feed drum;

(e) substantially continuously transporting said sulfur loaded solid particles from said regenerator feed drum to a regeneration zone;

(f) contacting said sulfur loaded solid particles with an oxygen-containing regeneration stream in said regeneration zone under regeneration conditions sufficient to remove sulfur from said sulfur loaded solid particles, thereby providing regenerated solid particles;

(g) batchwise transporting said regenerated solid particles from said regeneration zone to said lock hopper that previously contained said sulfur loaded particles from said desulfurization zone;

(h) pressurizing said lock hopper to a fill pressure, thereby providing a pressurized lock hopper;

(i) batchwise transporting said regenerated solid particles from said pressurized lock hopper to a reducing zone; and (j) contacting said regenerated solid particles with a hydrogen-containing reducing stream in said reducing zone under reducing conditions sufficient to reduce said solid particles, thereby providing reduced solid particles.

2. The method for claim 1, further comprising:

(k) batchwise transporting said reduced solid particles from said reducing zone to said desulfurization zone.

3. The method of claim 2, wherein step (k) is carried out while maintaining said reduced solid particles in dense phase.

4. The method of claim 1, wherein step (e) includes dilute phase transporting said sulfur-loaded solid particles.

5. The method of claim 1, wherein step (b) and (d) are accomplished via gravity flow.

6. The method of claim 1, wherein step (a) includes contacting said hydrocarbon-containing fluid with a fluidized bed of said solid particles, wherein step (f) includes contacting said oxygen-containing regeneration stream with a fluidized bed of said sulfur-loaded solid particles, and wherein step (j) includes contacting said hydrogen-containing reducing stream with a fluidized bed of said regenerated solid particles.

7. The method of claim 1, wherein said desulfurization conditions, said regeneration conditions, and said reducing conditions each include a superficial velocity of less than about 10 feet per second.

8. The method of claim 1, wherein steps (a) and (g) are carried out simultaneously.

9. The method of claim 2, wherein during step (k), the pressure in said desulfurization zone is maintained within about 10 psi of the pressure in said reducing zone.

10. The method of claim 1, wherein said desulfurization conditions include a weighted hourly space velocity in the range of from about 0.1 to about 10 $hr^{-1}$.

11. The method of claim 1, wherein said solid particles comprise zinc oxide and a promoter metal component.

12. The method of claim 11, wherein said promoter metal component comprises a promoter metal selected from the group consisting of nickel, cobalt, iron, manganese, tungsten, silver, gold, copper, platinum, zinc, tin, ruthenium, molybdenum, antimony, vanadium, iridium, chromium, palladium, and conditions thereof.

13. The method of claim 12, wherein said promoter metal is nickel.

14. The method of claim 12, wherein said promoter metal component is a substitutional solid solution of said promoter metal and zinc.

15. The method of claim 11, wherein step (a) includes converting at least a portion of said zinc oxide to zinc sulfide.

16. The method of claim 15, wherein step (g) includes converting at least a portion of said zinc sulfide to zinc oxide.

17. The method of claim 15, wherein step (g) includes oxidizing said promoter metal component, thereby providing an oxidized promoter metal component.

18. The method of claim 15, wherein step (j) includes reducing said oxidized promoter metal component.

19. The method of claim 1, wherein said solid particles have a mean particle size in the range of from about 20 to about 150 microns.

20. The method of claim 1, wherein said solid particles have a Group A Geldart classification.

21. The method of claim 1, wherein prior to said transporting in step (d), said sulfur loaded solid particles are contacted with a stripping gas in said lock hopper under stripping conditions sufficient to remove said hydrocarbon-containing fluid from around said sulfur loaded solid particles.

22. The method of claim 1, wherein prior to pressurizing said lock hopper in step (h), said regenerated solid particles are contacted with a stripping gas in said lock hopper under stripping conditions sufficient to remove oxygen.

23. A process in accordance with claim 1, wherein said fill pressure is within 20 percent of the pressure in said desulfurization zone and wherein said drain pressure is within 20 percent of the pressure of said regeneration zone.

24. A process in accordance with claim 1, wherein the pressure in said desulfurization zone is in the range of from about 50 to about 750 psig and wherein the pressure in said regeneration zone is in the range of from about 10 to about 250 psig.

25. A process in accordance with claim 1, wherein said drain pressure is at least 50 psi less than said fill pressure.

* * * * *